United States Patent [19]

Kawaguchi

[11] 4,173,500

[45] Nov. 6, 1979

[54] PROCESS FOR PRODUCING POROUS CAST IRON

[75] Inventor: Kenryo Kawaguchi, Yamato, Japan

[73] Assignee: Oiles Kogyo Kabushiki Kaisha, Tokyo, Japan

[21] Appl. No.: 808,564

[22] Filed: Jun. 21, 1977

[30] Foreign Application Priority Data

Jun. 25, 1976 [JP] Japan ..... 51/74524

[51] Int. Cl.[2] ..... C21D 1/48

[52] U.S. Cl. ..... 148/16; 148/138; 148/35; 75/20 F; 75/123 CB; 75/129

[58] Field of Search ..... 148/16, 35, 138; 75/20 F, 123 CB, 129

[56] References Cited

U.S. PATENT DOCUMENTS

| | | | |
|---|---|---|---|
| 2,435,946 | 2/1948 | Robiette et al. | 148/35 |
| 2,892,745 | 6/1959 | Kawasaki | 148/35 |
| 3,116,179 | 12/1963 | Carpenter et al. | 148/16 |

*Primary Examiner*—R. Dean
*Assistant Examiner*—John P. Sheehan
*Attorney, Agent, or Firm*—Oldham, Oldham, Hudak & Weber Co.

[57] ABSTRACT

A process for producing porous cast iron, wherein cast iron having flake graphite structure is subjected to heat treatment in a high temperature gas atmosphere in which the iron component of the cast iron base is not subjected to oxidation and on the other hand the flake graphite is subjected to oxidation, whereby the flake graphite disappears from the cast iron to form pores therein.

9 Claims, 4 Drawing Figures

PROCESS FOR PRODUCING POROUS CAST IRON

BACKGROUND OF THE INVENTION

There have been proposed many methods for producing porous cast iron, for example, U.S. Pat. No. 2,763,583 disclosed that if a cast iron is alternately and repeatedly subjected to heating up to a temperature of its $A_1$ transformation point and cooling to an ambient room temperature, the cast iron becomes porous because the phenomenon of expansion of the volume of graphite contained in the cast iron i.e., the phenomenon of the so-called "growth" of the graphite takes place together with the phenomenon of "growth" of the cast iron and then the phenomenon of cracking along the graphite takes place.

It is also well known that the porous cast irons thus obtained are excellently permeable with oil and are useful for machine parts, for example, such as bearings.

There is also disclosed in Japanese Patent Nos. 276,978 and 620,648 that aluminum or tellurium is added to the cast iron in order to increase oil content or to decrease the number of times of the heat treatment due to the increase of growth rate.

However, there have been defects in the conventional methods for producing the porous cast iron in that repeatedly heating and cooling the cast iron take a long time for the heating and cooling treatment.

SUMMARY OF THE INVENTION

A main object of this invention is to provide a novel process for producing porous cast iron without repeatedly heating and cooling the cast iron.

The process comprises a step of heating a cast iron having a flake graphite structure for 1 to 5 hours in high temperature gas atmosphere in which the iron component of the cast iron base is not subjected to oxidation and on the other hand the flake graphite is subjected to oxidation, whereby the flake graphite disappears from the cast iron to form pores therein.

Another object of this invention is to provide machine parts, such as bearing being manufactured by impregnating the porous cast iron with lubricant oil or inserting metal having low melting point.

DESCRIPTION OF THE PREFERRED EMBODIMENTS

Figure 1:
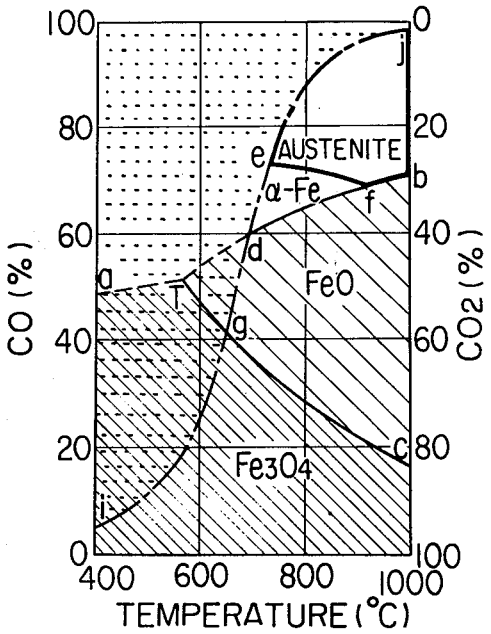
FIG. 1 is an equilibrium diagram among CO, $CO_2$ and steel.
Figure 3:
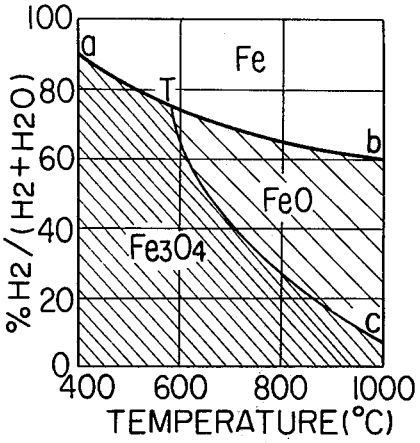
FIG. 3 is an equilibrium diagram between $H_2+H_2O$ and iron.
Figure 4:
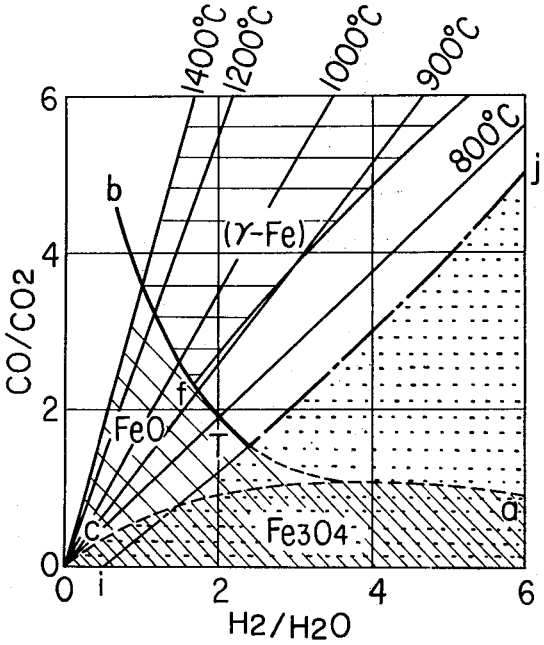
FIG. 4 is an equilibrium diagram among $CO/CO_2$, $H_2/H_2O$ and iron.

Referring to the drawings, the gas atmosphere in which iron component of the cast iron base is not subjected to oxidation and on the other hand graphite is subjected to oxidation can be obtained in FIG. 1 in the region surrounded by marks j, e, d, f and b of the equilibrium diagram among CO, $CO_2$ and steel, in FIG. 3 in the region above the line a-T-b of the equilibrium diagram between $H_2+H_2O$ and iron and in FIG. 4 in the region above the line b-f-T-j of the equilibrium diagram among $CO/CO_2$ (but $CO+CO_2=0.3$ atm.) and iron, respectively.

Figure 2:
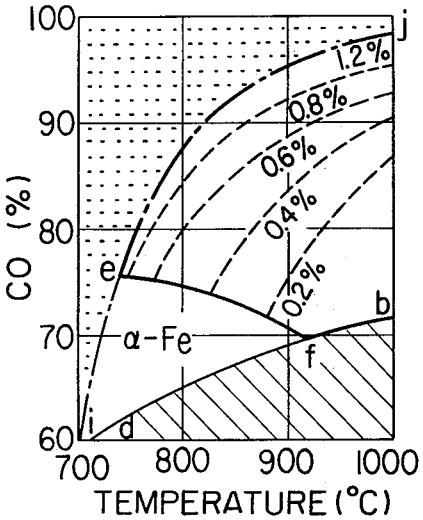
FIG. 2 is an enlarged view of an important section of FIG. 1.

Referring to the heat treatment of the cast iron in the region surrounded by marks j, e, d, f and b in FIGS. 1 and 2, in FIG. 2 which shows the region surrounded by marks j, e, d, f and b in FIG. 1, the dotted lines show equilibrium carbon concentration (C-potential) in relationship between $CO$-$CO_2$ atmosphere and carbon content of steel.

We will now explain about a heat treatment of the cast iron having flake graphite structure at temperature of 900° C. in the $CO$-$CO_2$ mixed gas atmosphere (80:20). The cast iron having flake graphite structure has, in general, metallographicly an organization wherein flake graphite or "graphite carbon" and carbon combined with iron of the cast iron or "combined carbon" are dispersed.

When the cast iron having such organization is subjected to the heat treatment at 900° C. in the mixed gas atmosphere mentioned above, two phenomena take place such that a part of the flake graphite diffuses into the cast iron base so as to disappear and that another part of the flake graphite reacts directly with $CO_2$ contained in the mixed gas according to the following reaction and disappears in the form of carbon monoxide; C(flake graphite)$+CO_2 \rightarrow 2CO$.

The phenomenon of disappearance of graphite takes place near the surfaces of the cast iron in the beginning of the heat treatment and then will take place at the middle of the cast iron as the time progresses so that the whole cast iron becomes porous.

On the other hand the "combined carbon" is contained usually in the amount of 0.4 to 0.8% by weight at the temperature below $A_1$ transformation point of the cast iron and its amount increases as the temperature rises because when it is heated to the temperature above $A_1$ transformation point, it transforms into solid-solution carbon.

When the cast iron is heated under the conditions mentioned above, a part of such solid-solution carbon diffuses into the pores formed by the reactions mentioned above. Consequently, a part of such carbon is oxidized with $CO_2$ contained in the mixed gas so that it disappears in the form of CO and another part diffuses in the cast iron base and disappears from the surface due to decarbonization.

Therefore, if the cast iron containing solid-solution carbon in the amount of 1.2% by weight at the temperature above $A_1$ transformation point, for example, 900° C. is subjected to the heat treatment in the region in FIG. 2 under the conditions mentioned above, the solid-solution carbon content will become less than 0.2% due to decarbonization.

This fact means that it is possible to change the organization of the cast iron base to that having desirable carbon content by selection of mixing ratio of the mixed gas and treating temperature.

The disappearance of the flake graphite contained in the cast iron due to oxidation and the decarbonization of combined carbon contained in the cast iron base take place similarly in the region above the line a-T-b in FIG. 3 and in the region surrounded by marks b, f, T and j in FIG. 4.

In the region above the line a-T-b in FIG. 3, the flake graphite contained in the cast iron disappears in the form of CO due to the following oxidation; C(flake graphite)$+H_2O \rightarrow CO+H_2O$, while the iron component of the cast iron base is not subjected to oxidation. The oxidation takes place in the inner part of the cast iron as the time progresses so that the flake graphite of the cast iron disappears to form pores therein. Thus, the cast iron becomes porous.

In the region above the line b-f-T-j in FIG. 4 also, the iron component of the cast iron base is not subjected to oxidation and on the other hand flake graphite is subjected to oxidation according to the following reactions; C(flake graphite)$+CO_2 \rightarrow 2CO$; C(flake graphite)$+H_2O \rightarrow CO+H_2$; to produce CO and disappears in the form of CO from the cast iron as the time progresses so that flake graphite disappears to form pores therein.

Since in the mixed gas comprising CO, $CO_2$, $H_2$ and $H_2O$, flake graphite of the cast iron is oxidized directly by $CO_2$and $H_2O$, the speed of the disappearance of graphite due to oxidation in this case is faster than that in the case of CO-$CO_2$ mixed gas.

According to the process for producing the porous cast iron of this invention, no oxide scale is produced during the heat treatment because the treatment is carried out in the mixed gas atmosphere in which only the flake graphite of the cast iron is oxidized without oxidizing the iron component of the cast iron base.

Therefore, the object of this invention can be accomplished by using any cast iron having flake graphite structure independently of its composition.

In actual operations, gray cast irons are used, comprising 2.8–4.0% by weight of carbon in total, 1.0–3.0% by weight of silicon, less than 1% by weight of other elements and the remainder of iron and having an organization in which perlite and ferrite are mixed. The gray cast irons, cut into a desirable shape, are subjected to heat treatment in the mixed gas atmosphere which is regulated to be in the regions mentioned above at temperature of about 900° C. for 1 to 5 hours. Then, by cooling the porous products are obtained, in which iron component of the cast iron base has not been oxidized at all and on the other hand flake graphite has disappeared to form pores therein.

It is recognized that the longer the heating time is, the oxidation and the graphite disappearance take place more at the inner portions of the cast iron. It is also recognized that the products obtainable from the heat treatment of this invention, especially the ones obtainable from the treatment for more than three hours can have an oil content equal to or greater than that of the products obtainable from the conventional method which comprises the repeated heating and cooling treatment. Measurement of the abovesaid oil content is performed by finishing the surface of the products and impregnating them with engine oil #30 at temperature of 120° C. for 60 minutes.

This invention will become clearer by the description with reference to the following examples. In the examples, samples of bushing shape were used.

EXAMPLE 1

The gray cast iron was melted in a cupola at the temperature of 1,450°±50° C. The gray cast iron comprises 3.56% by weight of carbon in total, 2.20% by weight of silicon, 0.56% by weight of manganese, 0.1% by weight of phosphorus, 0.1% by weight of sulfur and the remainder of iron. The melted gray cast iron was poured into a sand mold at casting temperature of 1,350°±50° C. to produce a casting of bushing shape having the outer diameter of 55 mm, the inner diameter of 33 mm and the length of 150 mm. Then the casting was finished to obtain a sample having the outer diameter of 52 mm, the inner diameter of 38 mm and the length of 40 mm. The sample has the metallographicly organization in which flake graphite is distributed in the base comprising a mixture of perlite and ferrite.

The sample was subjected to heat treatment in CO—$CO_2$ mixed gas atmosphere ($CO:CO_2=75:25$) at the temperature of 970° C. for 1 to 5 hours.

The results obtained from this treatment are reported in Table 1 showing heating time; distance from the outer or inner surface of the cast iron to pores formed by oxidation of graphite and subsequent disappearance; and oil content.

Table 1

| Heating Time (hours) | Distance from outer or inner surface of cast iron to pores formed by oxidation of graphite and subsequent disappearance (mm) | Oil Content (% by weight) |
|---|---|---|
| 1 | 0.4–0.5 | 0.2–0.3 |
| 2 | 0.7–0.8 | 0.3–0.4 |
| 3 | 0.9–1.1 | 0.4–0.5 |
| 4 | 1.2–1.3 | 0.5–0.6 |
| 5 | 1.3–1.5 | 0.6–0.7 |

EXAMPLE 2

The sample same to that of Example 1 was subjected to heat treatment in CO—$CO_2$—$H_2$—$H_2O$ mixed gas atmosphere ($CO:CO_2:H_2:H_2O=35:2:58:5$) at the temperature of 970° C. for 1 to 5 hours.

The obtained results are reported in Table 2.

Table 2

| Heating Time (hours) | Distance from outer or inner surface of cast iron to pores formed by oxidation of graphite and subsequent disappearance (mm) | Oil Content (% by weight) |
|---|---|---|
| 1 | 0.5–0.6 | 0.2–0.3 |
| 2 | 0.9–1.0 | 0.3–0.5 |
| 3 | 1.1–1.3 | 0.4–0.6 |
| 4 | 1.4–1.6 | 0.6–0.7 |
| 5 | 1.7–1.8 | 0.7–0.8 |

EXAMPLE 3

The sample same to that of Example 1 was subjected to the heat treatment in CO—$CO_2$—$H_2$—$H_2O$ mixed gas atmosphere at the temperature of 970° C. for 1 to 5 hours.

In this case the mixed gas atmosphere comprises CO 26% by volume, $CO_2$ 6% by volume, $H_2$ 50% by volume and $H_2O$ 18% by volume.

The obtained results are reported in Table 3.

Table 3

| Heating Time (hours) | Distance from outer or inner surface of cast iron to pores formed by oxidation of graphite and subsequent disappearance (mm) | Oil Content % by weight) |
|---|---|---|
| 1 | 0.6–0.8 | 0.2–0.4 |
| 2 | 1.1–1.3 | 0.4–0.6 |
| 3 | 1.5–1.7 | 0.6–0.8 |
| 4 | 1.8–2.0 | 0.8–1.0 |
| 5 | 2.0–2.5 | 0.9–1.1 |

Although in the examples 2 and 3, the heat treatment was carried out in a similar mixed gas atmosphere, it is apparent from the results reported in the Tables 2 and 3 that in the products obtained in the example 3 the disappearance of graphite has taken place deeper into the bushing and such products have higher oil content property in comparison with the ones obtained in the example 2.

More especially, it is found that even if the heat treatment is carried out in the gas atmosphere belonging to the region surrounded by marks b, f, T and j in FIG. 4, it is possible to increase the speed and the degree of the disappearance of graphite by selecting the mixing ratio of the mixed gas nearer the line b-f-T-j and the higher heating temperature.

According to the method of this invention for producing the porous cast iron comprising a step of heating the cast iron in the mixed gas atmosphere in which iron component of the cast iron base is not subjected to oxidation, the time necessary for the heat treatment is very short because no oxide scale is produced on the surfaces of the cast iron during the heat treatment so that the mixed gas can be contacted with the flake graphite directly and therefore the graphite can be oxidized for a short time.

In the examples 1, 2 and 3 the castings of bushing shape were used after cutting the casting surface to expose the flake graphite. However, even if the cast iron is subjected to the heat treatment without cutting, it is able to obtain a good porous cast iron.

This will be proved by the following example 4.

EXAMPLE 4

According to the procedure similar to that of the example 1, the casting of bushing shape was molded, having the outer diameter of 55 mm, the inner diameter of 33 mm and the length of 150 mm. The casting was subjected to the heat treatment in the mixed gas atmosphere having the same composition to that of the example 3 at the temperature of 970° C. for 3 to 5 hours without cutting the casting surfaces.

The results obtained are reported in Table 4.

Table 4

| Heating Time (hours) | Distance from outer or inner surface of cast iron to pores formed by oxidation of graphite and subsequent disappearance (mm) |
|---|---|
| 3 | 0.9–1.2 |
| 4 | 1.2–1.4 |
| 5 | 1.4–1.7 |

In general, graphite is distributed finely in the as-cast surface of the casting. This fact means that the flake graphite is not easily subjected to the direct oxidation.

However, as seen from the results reported in the Table 4, it is apparent that the thus obtained products have many pores formed by the disappearance of the flake graphite. In the heat treatment of this invention the disappearance of graphite from the cast iron seems to take place smoothly because the iron component of the cast iron base is not subjected to the oxidation in the mixed gas atmosphere and the flake graphite can diffuse into the cast iron base and then can diffuse therein.

Referring to the example 5, explanation is made in relation to a method of obtaining a porous cast iron having the pores formed in more inner positions of the cast iron in comparison with that obtained in the examples mentioned above.

In the example 5 the casting of bushing shape was subjected to the heat treatment of this invention, after repeatedly being heated to the temperature above its $A_1$ transformation point and being cooled to the temperature below its $A_1$ transformation point in order to grow the flake graphite in the cast iron according to the conventional method.

EXAMPLE 5

According to the procedure similar to that of the example 1, the casting of bushing shape was molded. The casting was subjected to the heating-cooling treatment one to three times. Thereafter samples having the outer diameter of 52 mm, the inner diameter of 38 mm and the length of 40 mm were obtained by cutting the casting.

These samples were subjected to the heat treatment in the mixed gas atmosphere having the same composition to that of the example 3 at the temperature of 970° C. for three hours.

The obtained results are reported in Table 5.

Table 5

| Number | Heating Time (hours) | Distance from outer or inner surface of cast iron to pores formed by oxidation of graphite and subsequent disappearance (mm) | Oil Content (% by weight) |
|---|---|---|---|
| 1 | 3 | 2.0–2.5 | 1.4–1.5 |
| 2 | 3 | 2.3–2.7 | 1.5–1.7 |
| 3 | 3 | 2.5–2.9 | 1.7–2.0 |

In the Table 5, No. 1, No. 2 and No. 3 are representative of the samples subjected to the heating-cooling treatment one time, two times and three times, respectively.

As seen from the results reported in the Table 5, it was found that the sample which was subjected to the heating-cooling treatment one time is not remarkably different from the sample which was subjected to the heating-cooling treatment three times in the distance from the outer or inner surface of the cast iron to the pores formed by the oxidation of graphite and subsequent disappearance and oil content. This seems to be caused by the fact that the degree of growth of the cast iron is the biggest in the first time heating in the heating-cooling treatments, compared with the other two treatments.

It is apparent from the results that it is able to obtain a porous cast iron having the oil content equal to or higher than 0.8% by weight by heating in the mixed gas atmosphere for 3 to 5 hours, while according to the conventional method it is necessary to repeat the heating-cooling treatment about ten times in order to obtain such porous cast iron.

Therefore, according to this invention, it is possible to obtain porous cast iron having desirable porosity and oil content in a short time in comparison with the conventional method utilizing the phenomenon of growth of the cast iron.

This invention has such merits as an increase of yield rate and capability of utilizing any usual cast iron having flake graphite structure independently of the composition of the cast iron.

Although the samples of bushing shape were used in the examples mentioned above, it is able equally to use the samples having other shape, for example, rod shape or plate shape.

It is possible to produce oilless bearings by inserting or impregnating the porous cast iron with low-melting-point metal, such as copper, copper alloy, lead, aluminum or the like; solid lubricating agents, such as molybdenum disulfide or the like; and synthesis resins, such as "Teflon", phenol resin or the like, instead of impregnating with lubricant oil.

What is claimed is:

1. A process for producing porous grey cast iron for bearings or the like comprising the step of heating a grey cast iron having mixed structures of perlite and ferrite and a flake graphite structure and consisting of 2.8–4.0 wt% of total carbon, 1.0–3.0 wt% of silicon, less than 1 wt% of elements selected from the group of Mn, P and S and the remainder of iron at a temperature of above $A_1$ transformation point of the cast iron for 1–5 hours in an atmosphere in which the flake graphite is subjected to oxidation to form pores therein, said atmosphere having the predetermined composition selected among the mixed gases of $CO—CO_2$, $H_2—H_2O$ and $CO—CO_2—H_2—H_2O$.

2. A process as claimed in claim 1 in which the heating is effected in an atmosphere of mixed gas of CO and $CO_2$ having the composition as shown in the region surrounded by the line J-e-d-f-b in FIG. 1 of the accompanying drawing.

3. A process as claimed in claim 1 in which the heating is effected in an atmosphere of mixed gas of $H_2$ and $H_2O$ having the composition as shown in the region above the line b-f-T-j in FIG. 4 of the accompanying drawing.

4. A process as claimed in claim 1 in which the heating is effected in an atmosphere of mixed gas of CO, $CO_2$, $H_2O$, and $H_2O$ having the composition as shown in the region above the line b-f-T-j in FIG. 4 of the accompanying drawing.

5. A process as in claim 4 where the heating action is provided in the range of from 1400° C. to 800° C. and the temperature is highest as said first ratio of CO to $CO_2$ and lowest when the $H_2$ to $H_2O$ ratio is about 6.

6. A process as in claim 1 where the heating is at a temperature of about 700° to 1000° C. and at a CO% above 60 and a $CO_2$% of below 40.

7. A process as in claim 6 where the gas atmosphere comprises CO to $CO_2$ in a ratio of 75 to 25.

8. A process as in claim 1 where the heating is at a temperature of about 900° C.

9. A process as in claim 1 where the heating atmosphere is varied within a range of a ratio of $H_2$ to $(H_2+H_2O)$ of about 0.90 down to a ratio of about 0.60 at the heating temperature correspondingly is varied from 400° to 1000° C.

* * * * *

UNITED STATES PATENT OFFICE

CERTIFICATE OF CORRECTION

PATENT NO. : 4,173,500

DATED : November 6, 1979

INVENTOR(S) : Kenryo Kawaguchi

It is certified that error appears in the above-identified patent and that said Letters Patent are hereby corrected as shown below:

Claim 3, Line 4 - "the line b-f-T-j in Fig. 4" should be -- the line a-T-b in Fig. 3 --;

Claim 4, Line 3 - "$H_2O$ and $H_2O$" should be -- $H_2$ and $H_2O$ --.

Signed and Sealed this

First Day of April 1980

[SEAL]

Attest:

SIDNEY A. DIAMOND

Attesting Officer

Commissioner of Patents and Trademarks